US007673855B2

(12) United States Patent
Anderson et al.

(10) Patent No.: US 7,673,855 B2
(45) Date of Patent: Mar. 9, 2010

(54) STEAM HUMIDIFIER QUICK LIQUID CONNECTION

(75) Inventors: Wayne R. Anderson, Eden Prairie, MN (US); Steven L. Wolff, Corcoran, MN (US); Brad Alan Terlson, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 315 days.

(21) Appl. No.: 11/874,648

(22) Filed: Oct. 18, 2007

(65) Prior Publication Data

US 2009/0102072 A1 Apr. 23, 2009

(51) Int. Cl.
*B01F 3/04* (2006.01)

(52) U.S. Cl. ..... 261/49; 261/58; 261/71; 261/72.1; 261/DIG. 76; 29/700

(58) Field of Classification Search ..... 261/42, 261/43, 49, 58, 66, 71, 72.1, 115, 118, 119.1, 261/141, 142, DIG. 10, DIG. 15, DIG. 65, 261/DIG. 76; 29/700; 239/136
See application file for complete search history.

(56) References Cited

U.S. PATENT DOCUMENTS 4,031,918 A 6/1977 Cagle
4,211,735 A * 7/1980 Berlin ..... 261/116
6,398,196 B1 * 6/2002 Light et al. ..... 261/130
7,068,924 B2 * 6/2006 Watanabe et al. ..... 392/386

OTHER PUBLICATIONS

Pictures of Hayward Universal Stop Cock Valves, Oct. 29, 2007, 3 pages.
"Control Valves," Hayward Flow Control Systems, from www.haywardindustrial.com/pdf/_control-valves/Needle_Angle_Univ.pdf, pp. 41-42, 2007.
"heaterSteam Electric Element Steam Humidifiers Installation and Maintenance Manual," Carel, 2007.

* cited by examiner

*Primary Examiner*—Scott Bushey

(57) ABSTRACT

In one aspect, a steam humidifier is disclosed. The steam humidifier includes a tank for containing water to be heated to generate steam and a water connection manifold that has a manifold chamber in fluid communication with a water supply passage and a water drain passage. The steam humidifier further includes a rotary valve that is configured to control a fluid passage between the tank and the manifold chamber and that is further configured to control the position of one or more locking features. The rotary valve is rotatable between a first locked position and a second unlocked position. In the first locked position, the fluid passage between the tank and the manifold chamber is open and the one or more locking features are engaged with a structure of the steam humidifier. In the second unlocked position, the fluid passage between the tank and the manifold chamber is closed and the one or more locking features are disengaged from the structure of the steam humidifier. Other aspects are disclosed.

19 Claims, 17 Drawing Sheets

STEAM HUMIDIFIER QUICK LIQUID CONNECTION

FIELD OF THE INVENTION

The invention relates to steam humidifiers, and more particularly, to constructions for a tank and liquid connections of a steam humidifier.

BACKGROUND OF THE INVENTION

The interior spaces of buildings are often at a lower than desired level of humidity. This situation occurs commonly in arid climates and during the heating season in cold climates. There are also instances in which special requirements exist for the humidity of interior spaces, such as in an art gallery or where other delicate items are stored, where it is desired that the interior humidity levels be increased above naturally occurring levels. Therefore, humidifier systems are often installed in buildings to increase the humidity of an interior space.

Humidification systems may take the form of free-standing units located within individual rooms of a building. More preferably, humidification systems are used with building heating, ventilation, and air conditioning (HVAC) systems to increase the humidity of air within ducts that is being supplied to interior building spaces. In this way, humidity can be added to the air stream at a centralized location, as opposed to having multiple devices that increase humidity at multiple points within the building interior. Additionally, because the air within ducts may be warmer than the interior space air during a heating cycle, the additional air temperature can help prevent water vapor from condensing in the vicinity of the humidifier, such as on the inside of the duct.

An issue associated with humidification system is that they should only discharge water vapor into a duct and not liquid water. Liquid water within a duct can create a number of serious problems. For example, liquid water that remains stagnant within a duct can promote the growth of mold or organisms that can release harmful substances into the air flow, potentially causing unhealthy conditions in the building. Liquid water can also cause rusting of a duct which can lead to duct failure, and can create leaks from the duct to the building interior spaces which are unsightly, can cause a slipping hazard, and can lead to water damage to the structure.

One known humidification method involves direct steam injection into an air duct of a building. This approach is most commonly used in commercial buildings where a steam boiler is present to provide a ready supply of pressurized steam. Steam humidification has the advantage of having a relatively low risk of liquid moisture entering a duct or other building space. However, pressurized steam injection systems are associated with a risk of explosion of the steam pressure vessels, as well as a risk of possibly burning nearby people, both of which are very serious safety concerns. In residential applications, there are usually no readily available sources of pressurized steam. An open bath humidifier system may be used, however these are difficult to install because they require a large hole in the duct and can only be used with horizontal or upflow ducts. Alternatively, a residential application may use direct steam injection from a separate unit to generate pressurized steam, but this separate unit is costly. Moreover, the system would suffer from the same disadvantages as are present in commercial direct steam injection systems.

One type of humidifier that is commonly used in residential applications that has the advantages of steam humidification without the need for a separate source of pressurized steam is a tank heater type humidifier. In this type of humidifier, heat is generated within a tank of water, causing the water to boil and steam to be generated. The heat input may be any of a number of different sources, however, commonly an electrical heating element is used. One problem associated with this type of humidifier is that as water is boiled off as steam, the impurities in the water remain in the tank. These impurities generally include minerals that are naturally occurring in most sources of water. Over time, the concentration of these impurities will tend to increase in the tank, leading to greater amounts of impurities that solidify and deposit on the surfaces inside the tank. These deposits can accumulate to the point of creating numerous problems. For example, deposits on a heating coil reduce the heat transfer rate to the water, resulting in lower steam production and possibly causing overheating and failure of the coil. Deposits in the tank can clog passages where water or steam flows in or out, resulting in the failure of the humidifier. It is therefore necessary for a user of a humidifier to occasionally remove the tank of the humidifier and manually clean the tank and associated components to remove the deposits and accumulations.

Improved constructions for humidification systems are desired. In particular, improved constructions for water tanks of steam humidifiers are needed, and specifically, constructions that permit the tank to be readily removed for cleaning. For example, improved techniques and constructions are desirable to allow a water supply line and/or a water drain line to be readily removed from a tank.

SUMMARY OF THE INVENTION

The invention relates to a liquid connection feature for steam humidifiers. In one aspect, a steam humidifier is disclosed. The steam humidifier includes a tank for containing water to be heated to generate steam and a water connection manifold that has a manifold chamber in fluid communication with a water supply passage and a water drain passage. The steam humidifier further includes a rotary valve that is configured to control a fluid passage between the tank and the manifold chamber and that is further configured to control the position of one or more locking features. The rotary valve is rotatable between a first locked position and a second unlocked position. In the first locked position, the fluid passage between the tank and the manifold chamber is open and the one or more locking features are engaged with a structure of the steam humidifier. In the second unlocked position, the fluid passage between the tank and the manifold chamber is closed and the one or more locking features are disengaged from the structure of the steam humidifier.

A second aspect of the invention relates to a steam humidifier that includes a tank for containing water to be heated to generate steam, where the tank has a generally cylindrical cavity and a water passage that fluidly connects a bottom portion of the tank to the generally cylindrical cavity. The steam humidifier further includes a main structure that is configured to support the tank and a valve manifold body that is configured to be supported by the main structure. The valve manifold body defines a water supply connection, a water drain connection, a manifold chamber that includes a generally cylindrical cavity, and one or more latching features. The valve manifold body further defines a first water supply passage that fluidly connects the water supply connection to the manifold chamber, where this first water supply passage is also configured to receive a water supply control valve. In addition, the valve manifold body also defines a second water supply passage that fluidly connects the water drain connection to the manifold chamber, where this second water supply passage is also configured to receive a water drain control valve. The steam humidifier also includes a rotary spool valve that is generally cylindrical and is positioned at least partially within the generally cylindrical cavity of the manifold chamber and at least partially within the generally cylindrical cavity of the tank. The rotary spool valve defines an axial fluid passage that intersects with an end surface of the rotary spool valve, and a radial fluid passage that intersects with a radial surface of the rotary spool valve and that is configured to be in fluid communication with the manifold chamber through the axial fluid passage. The rotary spool valve also defines one or more latching tabs that are configured to engage the one or more latching features of the valve manifold body, and one or more seals that are positioned about the intersection of the radial fluid passage with the radial surface of the rotary spool valve. The steam humidifier further includes a handle secured to an end of the rotary spool valve.

Another aspect of the invention relates to a method of removing a tank of a steam humidifier. The method includes closing one or more valves in a valve manifold body to isolate a water supply and a water drain from a manifold chamber of the valve manifold body. The method further includes rotating a handle attached to a rotary spool valve to cause a fluid passage leading from the tank to the manifold chamber of the valve manifold body to be blocked and causing locking features of the rotary spool to disengage from a supporting structure of the steam humidifier. Furthermore, the method includes removing the tank and the rotary spool valve from the supporting structure.

The invention may be more completely understood by considering the detailed description of various embodiments of the invention that follows in connection with the accompanying drawings.

Figure 1:
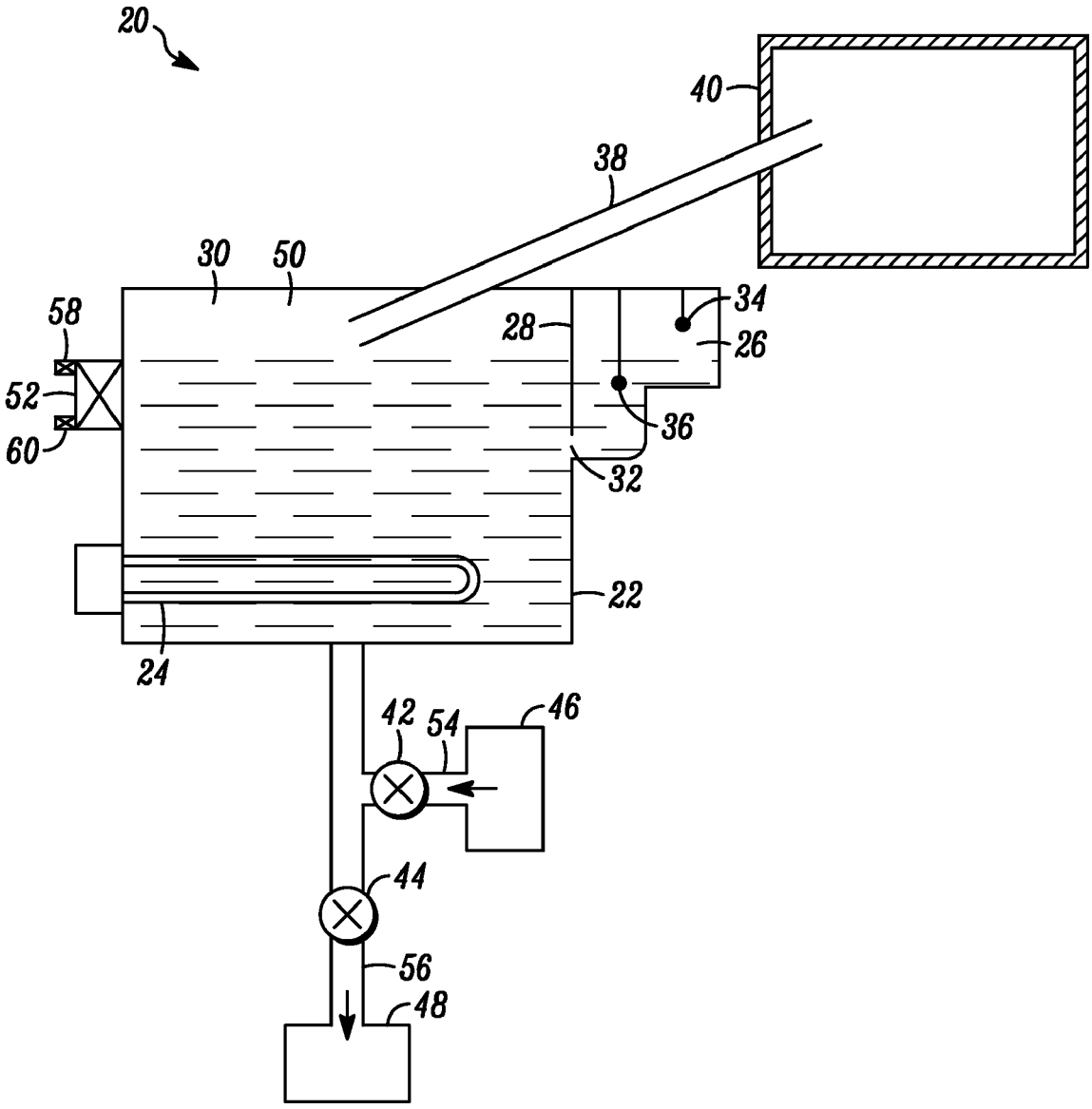
FIG. 1 is a cross-sectional view of a tank heater type steam humidifier.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

As described above, minerals, sediments, and other impurities present in water tend to deposit in the tank of a tank heater type humidifier over the course of its operation. These deposits can build up and cause damage and interfere with the proper functioning of the humidifier. The rate at which these deposits form depend on a number of variables, including the mineral content of the water (hardness) and the amount of time that the humidifier is operated. It is generally recommended or required that the user of a humidifier disassemble and manually clean the tank and associated parts at a regular interval, such as every year. In some cases, a humidifier may provide an indication to the user that the tank needs to be cleaned, such as a visual indication or an audible indication. It is therefore that the user of a humidifier remove the tank at regular intervals and manually clean it to remove the deposits and accumulations.

An embodiment of a tank heater type humidifier is depicted schematically in FIG. 1. Humidifier 20 includes a tank 22 configured to retain a volume of liquid water. Tank 22 is generally constructed out of material that is sufficiently resistant to high temperatures, such as the temperature of boiling water. Examples of suitable materials for tank 22 are temperature resistant plastics, an example of which is a thermoplastic resin such as a polyphenylene ether/polystyrene blend, and stainless steel. A heating coil 24 is also provided to heat water within tank 22. Heating coil 24 is generally an electric heating coil that generates heat when an electric current is passed through a resistive material. However, other types of heating coils 24 are usable. For example, heating coil 24 could pass a heated material such as a heated liquid through a tube that allows heat to transfer to the liquid in the tank 22. Furthermore, a heater may be substituted for heating coil 24, where a heater is of a conventional liquid heating design, such as a propane or natural gas liquid heater or a fuel oil burner. In other embodiments, heating coil 24 may function by passing an electric current through the water to generate heat.

Tank 22 is shown in FIG. 1 as having an isolated chamber 26 that is separated from a main chamber 30 of tank 22 by baffle 28. Isolated chamber 26 is in fluid communication with main chamber 30 by way of opening 32 which allows liquid from main chamber 30 to flow into isolated chamber 26 and to reach the same fluid level as in main chamber 30. In some embodiments, isolated chamber 26 includes a vent from an upper portion of the isolated chamber 26 to an upper portion of the main chamber 30 to prevent excessive or irregular pressure build-up in the isolated chamber, which could in turn cause erratic or inaccurate water level sensing in the isolated chamber 26. Isolated chamber 26 tends, however, to be insulated from ripples, bubbles, and other fluctuations of the water level in main chamber 30, and therefore is a suitable location for measuring the water level in tank 22. FIG. 1 also shows that a high level water sensor 34 and a low level water sensor 36 are present within isolated chamber 26. Sensor 36 detects the presence of water at a first level and sensor 34 detects the presence of water at a second level, where the first level is lower than the second level. Each of sensors 34, 36 is configured to detect the presence of water at the particular sensor. Sensors 34, 36 may be a current-detection type of sensor, where a source of current such as low voltage alternating current is applied at a point in the tank that is below both sensors 34, 36 and where sensors 34, 36 are configured to detect the presence of current which indicates a current path from the source of current, through the water, to sensors 34, 36. Humidifier 20 further includes a tube 38 that projects from main tank chamber 30 to the interior of an air duct 40 and that provides a fluid connection for the flow of steam from main tank chamber 30 to the interior of air duct 40.

Humidifier 20 includes a fill valve 42 and a drain valve 44. Fill valve 42 is in fluid communication through conduit 54 with a water supply 46, such as a municipal water supply system or a well pump system. Drain valve 44 is in fluid communication through a conduit 56 with a water receiving system 48, such as a municipal water treatment system, a septic system, or a drain field. Humidifier 20 further includes a controller 52 that is in communication with water level sensors 34, 36 and has the ability to control the fill and drain valves 42, 44. Controller 52 also includes one or more timers configured to measure elapsed times.

Figure 2:
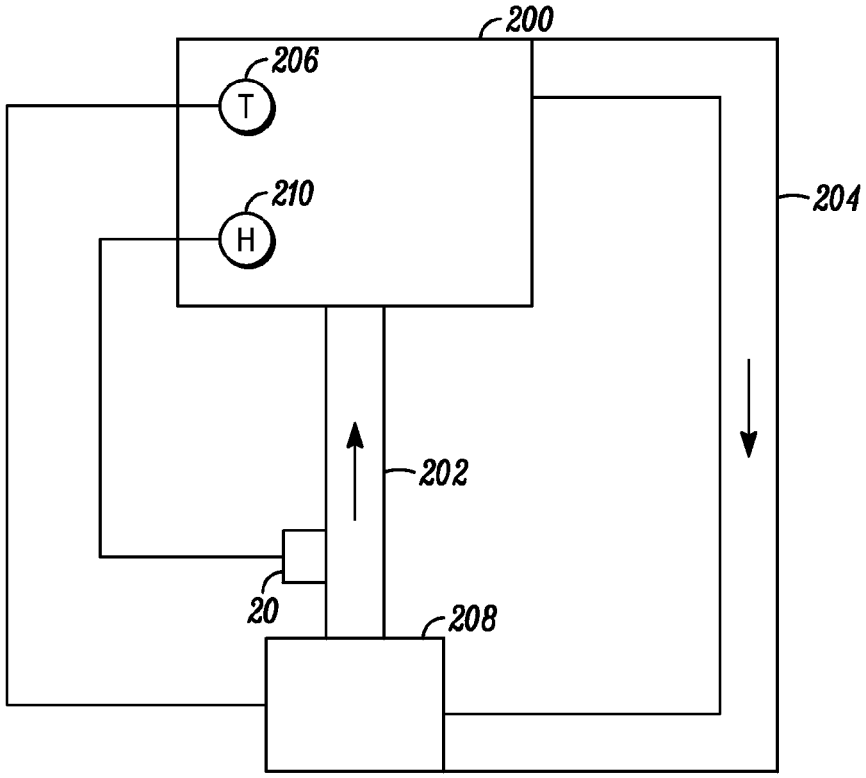
FIG. 2 is a schematic representation of an HVAC system having a humidifier.

A typical heating, ventilation, and air conditioning (HVAC) installation that includes a humidifier is depicted in FIG. 2. Conditioned space 200 of a building is configured to receive conditioned air from supply duct 202 and to provide for return air flow through return duct 204. Conditioned space 200 includes at least one thermostat 206 that is in communication with conditioning device 208. Conditioning device 208 may be a furnace, a boiler, an air conditioner, a heat exchanger, or a combination thereof, that is configured to condition return air from return duct 204 and deliver the conditioned air to supply duct 202. Conditioning air may involve increasing the temperature of the air, decreasing the temperature of the air, cleaning the air, or other such processes. Conditioning device 208 generally includes a fan or blower for drawing air from return duct 204 and delivering air through supply duct 202. Thermostat 206 senses the temperature in conditioned space 200 and activates conditioning device 208 when the temperature deviates from a set value. When conditioning device 208 is activated by a call for conditioning from thermostat 206, conditioned air is supplied through supply duct 202 to adjust the temperature of conditioned space 200 until the temperature sensed by thermostat 206 satisfies a set value. In some embodiments, thermostat 206 may be configured to receive an input to run a fan or blower without temperature conditioning of the air. In this case only the fan or blower portion of conditioning device 208 is activated and air is supplied through supply duct 202 without being conditioned by conditioning device 208.

FIG. 2 also shows a typical installation of humidifier 20. Humidifier 20 is installed on supply duct 202 downstream of conditioning device 208. A humidistat 210 is installed in conditioned space 200 or within return duct 204 and is in communication with humidifier 20. One embodiment of a humidistat 210 senses the relative humidity level (RH) present in conditioned space 200 and activates humidifier 20 when the humidity level falls below a set value. Other embodiments of humidistat 210 sense indoor dewpoint or even outdoor dewpoint in combination with either indoor RH or indoor dewpoint. In some embodiments, the thermostat 206 will incorporate the functionality of humidistat 210. When humidifier 20 is activated, humidity is added to conditioned air within supply duct 202 in order to increase the humidity in conditioned space 200. In some embodiments, humidifier 20 and/or humidistat 210 are configured to activate humidifier 20 only when conditioning device 208 is activated. This ensures that air is flowing through supply duct 202 to carry the additional humidity to conditioned space 200. If humidifier 20 is activated without air flowing in supply duct 202, the additional humidity provided by the humidifier may condense on the walls of the duct and cause damage, and the additional humidity will also not be effectively delivered to conditioned space 200. In other embodiments, the conditioning device 208 will be activated any time there is a demand for humidification from humidistat 210.

In operation of humidifier 20, when there is a call for humidification, humidifier 20 is filled by opening fill valve 42 to allow water from supply 46 to flow through conduit 54 into main chamber 30 of tank 22 and to isolated chamber 26. Fill valve 42 will remain open until water is detected at high water sensor 34, at which point fill valve 42 is closed. In some embodiments, an overfull sensor is provided that detects the presence of water above high water sensor 34, in which case fill valve 42 is closed. Heating coil 24 is then energized, causing the temperature of the water in tank 22 to increase in temperature. In some embodiments, water tank 22 is filled prior to there being a demand for humidification, such as at installation or system start-up, and then waits for a call for humidification to energize the heating coil 24. As the water in tank 22 is heated, the water in tank 22 will begin to boil and steam will form at the top 50 of tank 22. A very slight pressure will be established in the top area 50 of tank 22, driving steam through tube 38 and into duct 40. Tube 38 is configured to allow sufficient steam to flow into duct 40 that very little pressure will build in tank 22. In other embodiments, no pressure or absolutely minimal pressure builds in tank 22 and steam is carried by convection into duct 40. The steam enters the air in duct 40 where it is carried to conditioned spaces within a building. As water is converted to steam, the water level in tank 22 will decrease. With sufficient operation, the water level will drop below the height of low water sensor 36. When water falls below the height of low level sensor 36, fill valve 42 will be opened and remain open until water reaches high level sensor 34.

Figure 3:
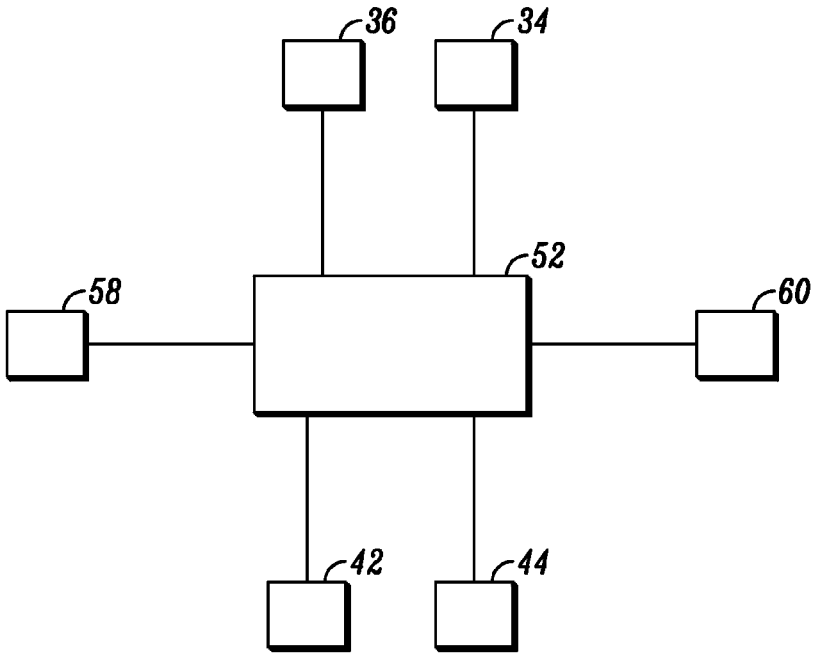
FIG. 3 is a schematic representation of a control system of a humidifier.

An embodiment of the components of a control system of humidifier 20 is depicted in FIG. 3. As shown in FIG. 3, controller 52 is in communication with high level sensor 34 and low level sensor 36. Controller 52 therefore receives signals representative of whether the water level in tank 22 is at or above low level sensor 36 and whether the water level in the tank 22 is at or above high level sensor 34. Controller 52 is further in communication with fill valve 42 and drain valve 44, and is able to control the operation of each. Controller 52 is also shown in FIG. 3 as being in communication with indicator 58. Indicator 58 may be used to communicate information to a user, such as the need to clean the tank. Controller 52 also has an input element 60 such as a switch or button configured to receive input from a user, such as to indicate that the humidifier has been cleaned.

Figure 4:
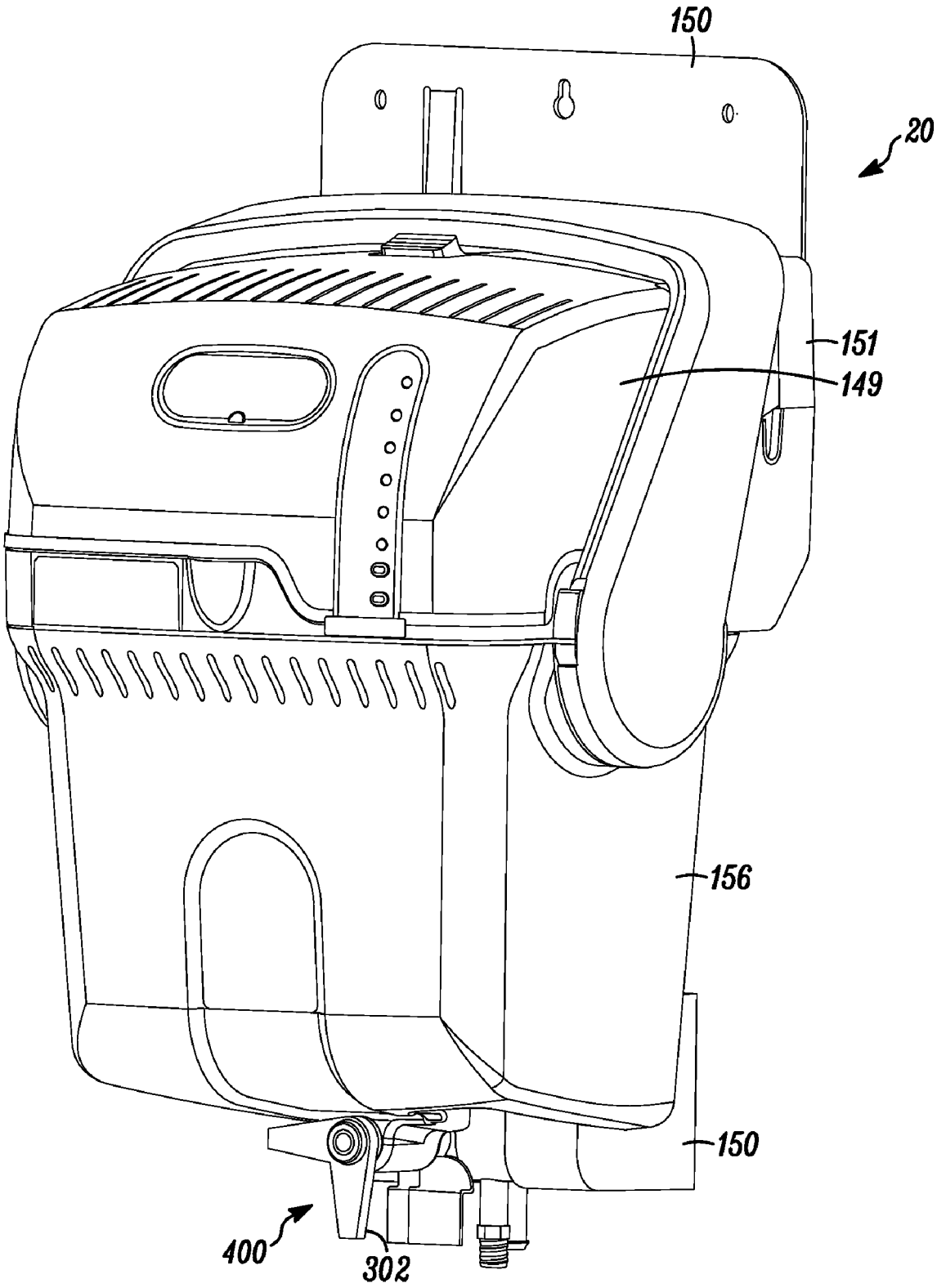
FIG. 4 is a front perspective view of a humidifier having a water tank with a quick liquid connection feature constructed according to the principles of the present invention.
Figure 5:
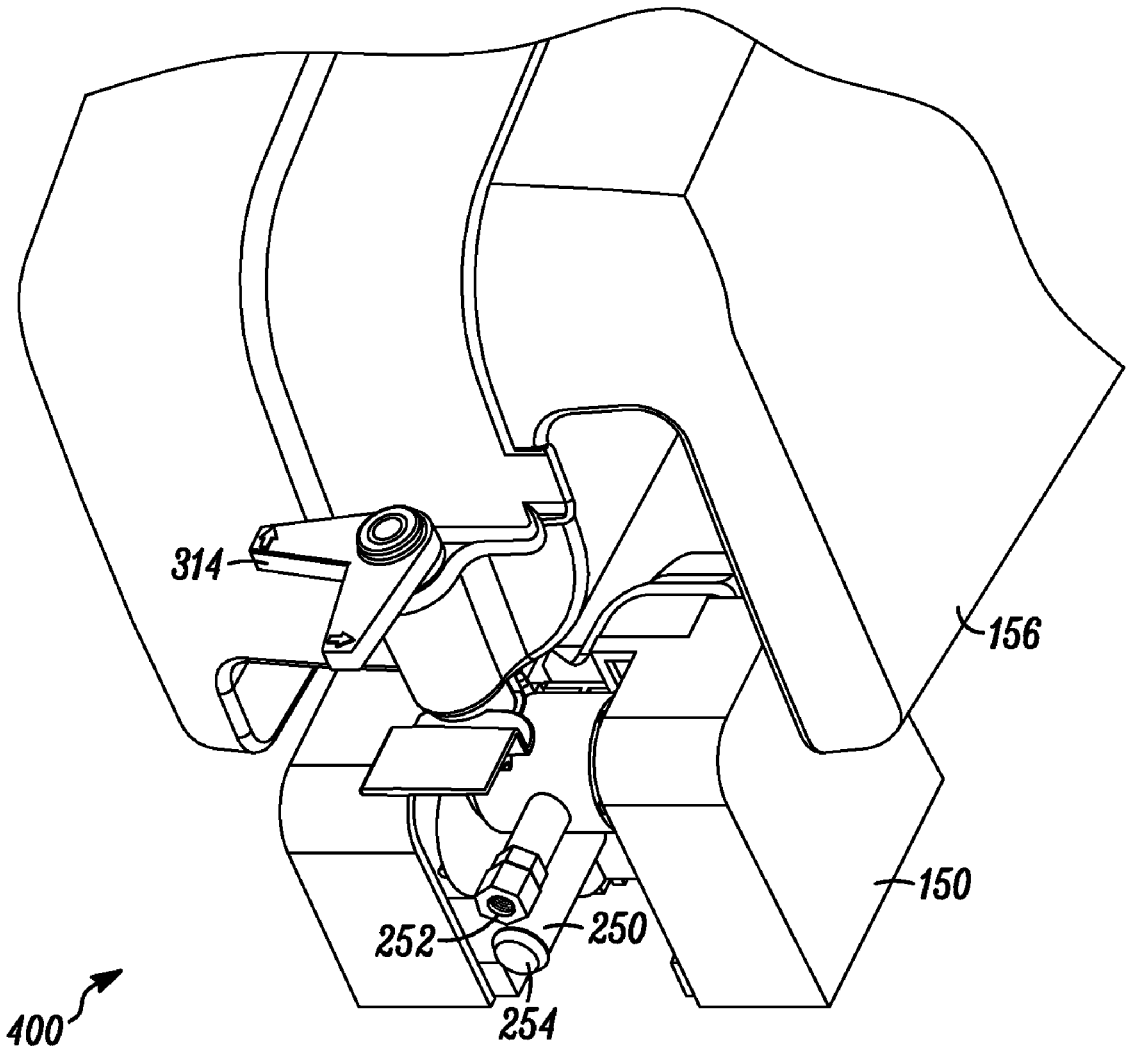
FIG. 5 is a perspective view of a lower portion of the humidifier of FIG. 4.

In use, tank 22 is preferably connected to a source of liquid water, such as a municipal water system or a well system, in order to provide the water that will be converted to steam to provide humidity. Tank 22 is also preferably connected to a liquid water drain, such as a municipal sewer system or a septic system, to allow the tank to be drained occasionally. A quick liquid connection feature constructed according to the principles of the present disclosure allows the tank to be readily serviced without requiring the removal of the individual liquid connections or requiring the use of tools. FIG. 4 is a front perspective view of a humidifier having a tank with a quick liquid connection feature 400 that allows the tank to be removed for cleaning in an expedient manner that does not require special tools or training. A close up of quick liquid connection feature 400 is shown in FIG. 5. This arrangement allows the tank to be removed without the user having to individually disconnect the water supply line and the water drain line. This is particularly advantageous because the typical humidifier user who has to remove the tank for cleaning is a homeowner who does not have special training, may not want to spend much time learning how to perform a procedure to remove the liquid connections from a tank, and may not have ready access to tools for removing the liquid connections from a tank.

Figure 12:
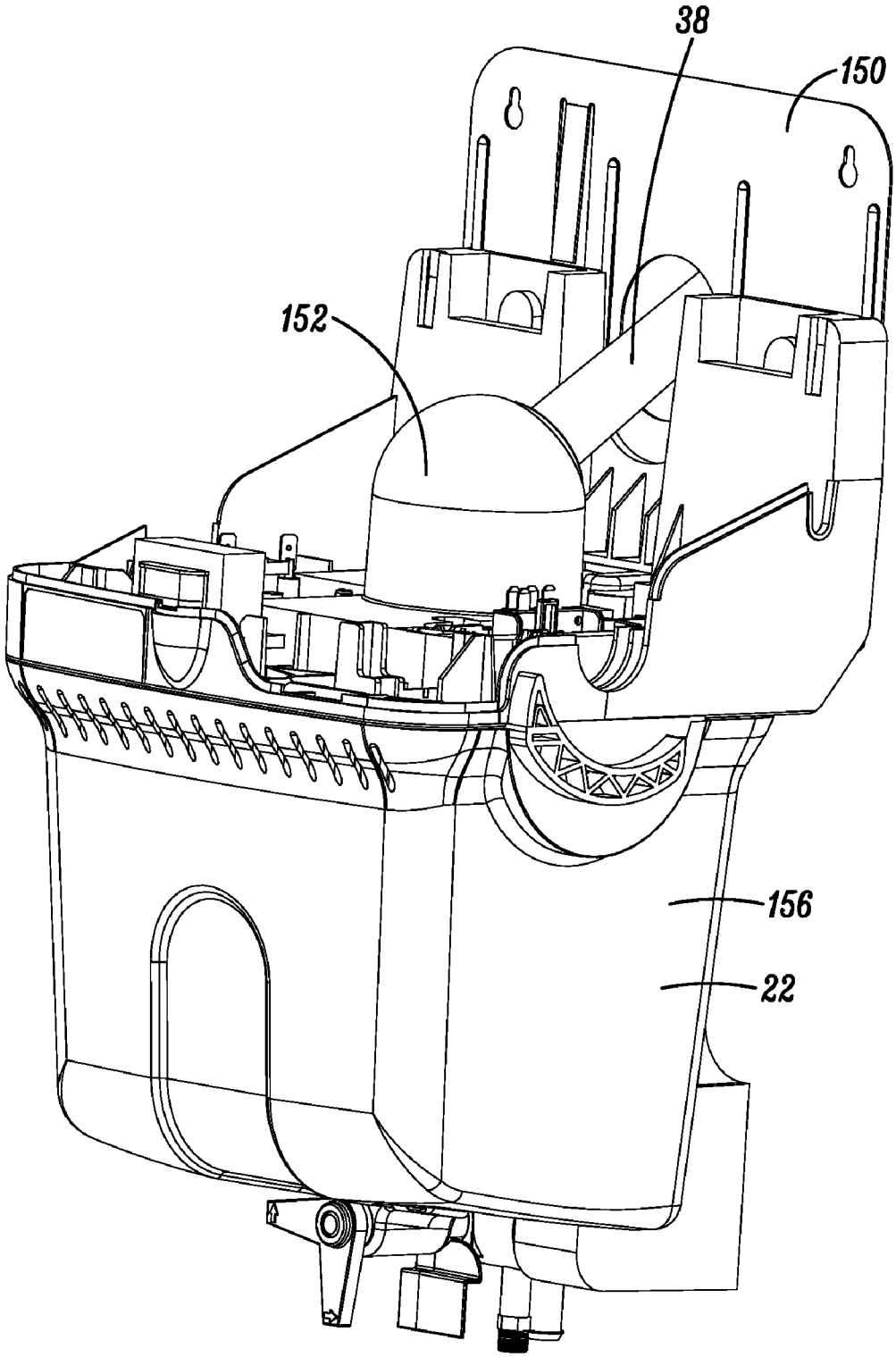
FIG. 12 is a front perspective view of a humidifier having various components removed to show details.
Figure 13:
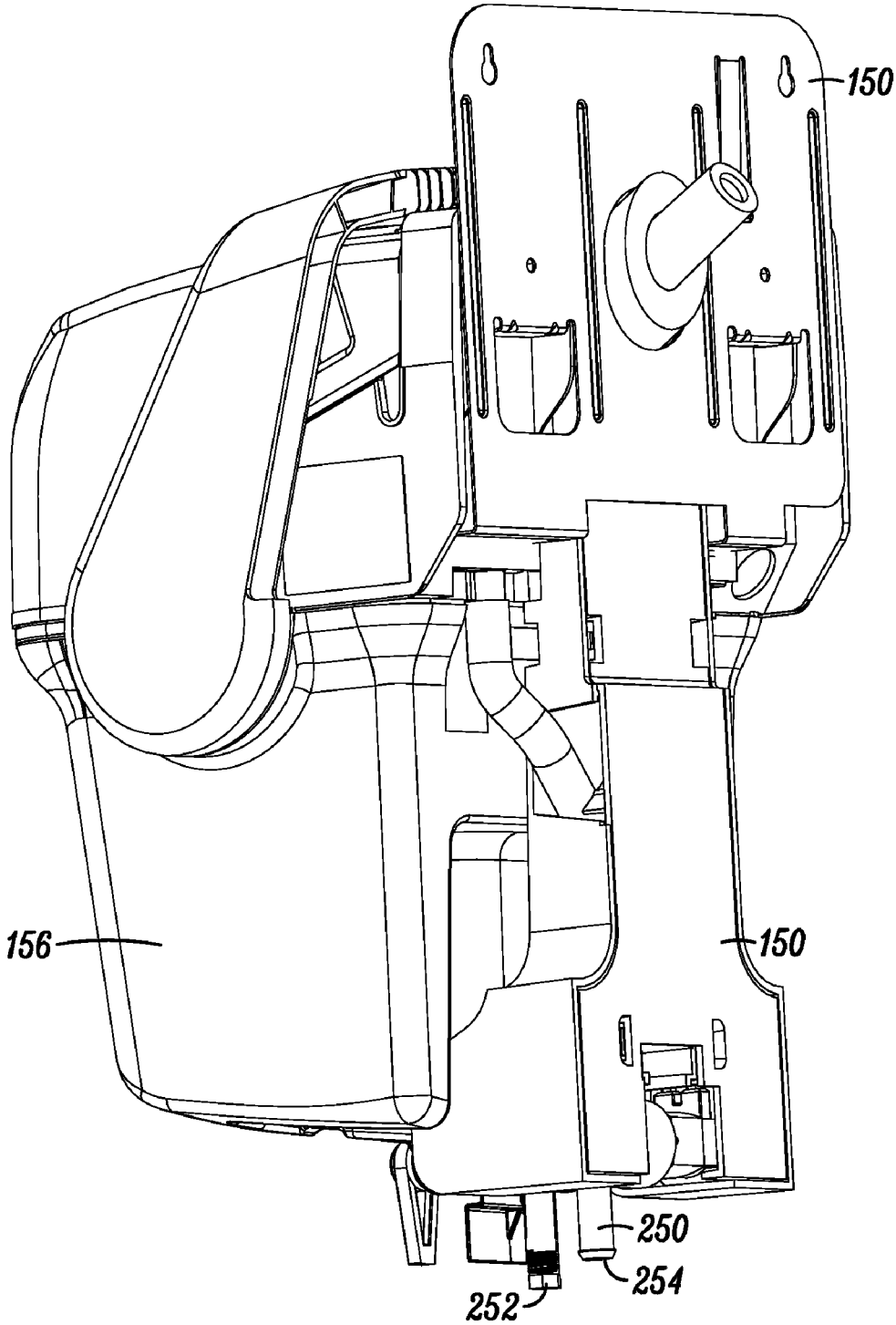
FIG. 13 is a rear perspective view of a steam humidifier.
Figure 14:
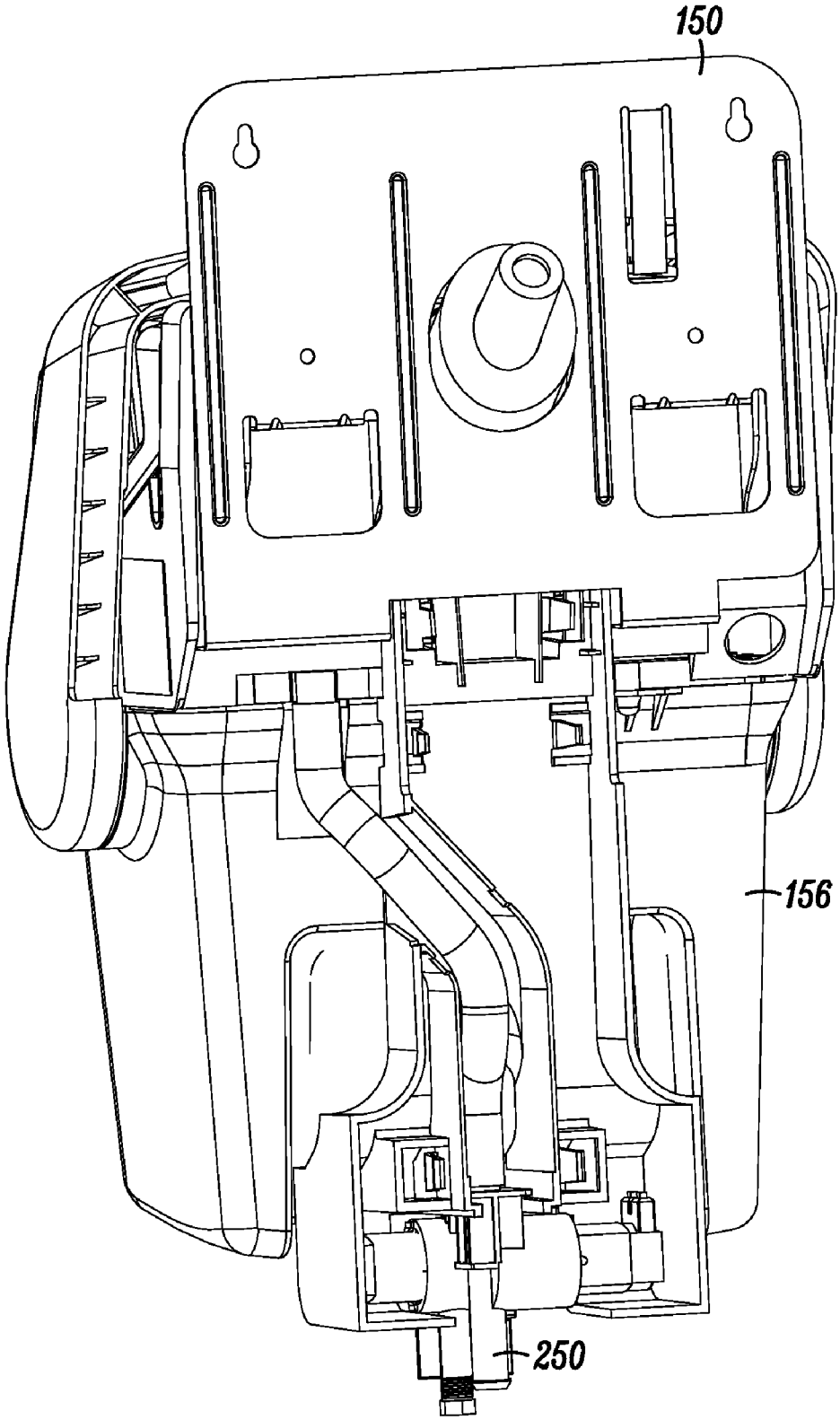
FIG. 14 is a rear perspective view of a steam humidifier having components removed to show details.

The humidifier 20 depicted in FIG. 4 includes a main structure 150 that is configured to be mounted to a duct or other attachment point within a building. Main structure 150 may consist of a single piece or may be formed from several pieces that are attached or secured to each other. Details of main structure 150 and associated components are shown in FIG. 12 where certain components are removed for clarity. Compared to FIG. 4, a cover 149 and handle 151 are not shown in FIG. 12. In one embodiment, main structure 150 and associated components are formed by injection molding. Main structure 150 also includes a structure for receiving steam tube 38, such as a steam dome 152, such that steam tube 38 is in fluid communication with tank 22. Tank 22 is partially defined by main structure 150 that forms an upper boundary of tank 22, and the remainder of tank 22 is defined by open top container 156. Open top container 156 is assembled to main structure 150 to form a watertight and steamtight enclosed volume that constitutes tank 22.

Figure 18:
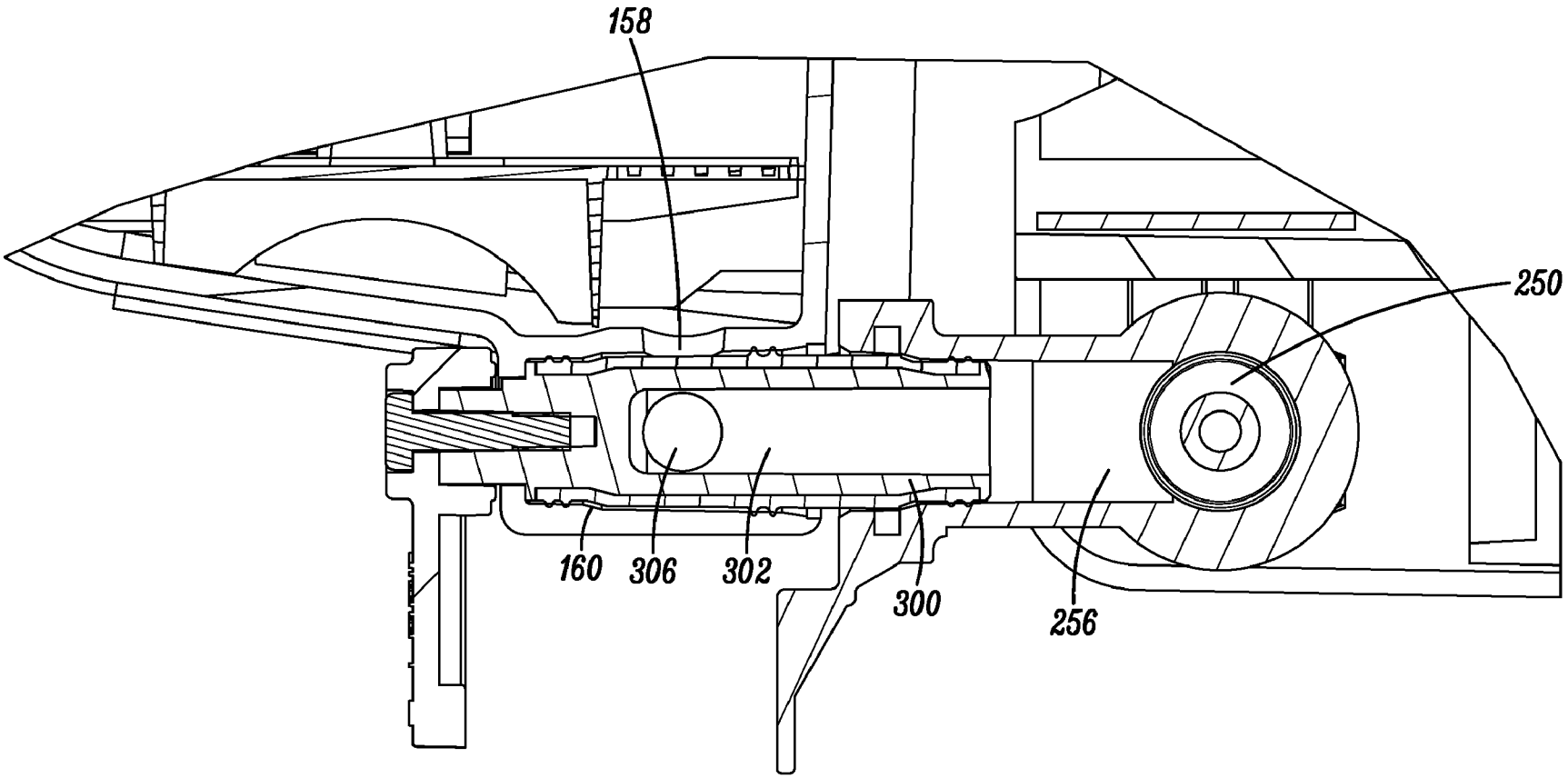
FIG. 18 is a cross-sectional view of a humidifier tank having a rotary spool valve within a cylindrical cavity of a valve manifold.
Figure 19:
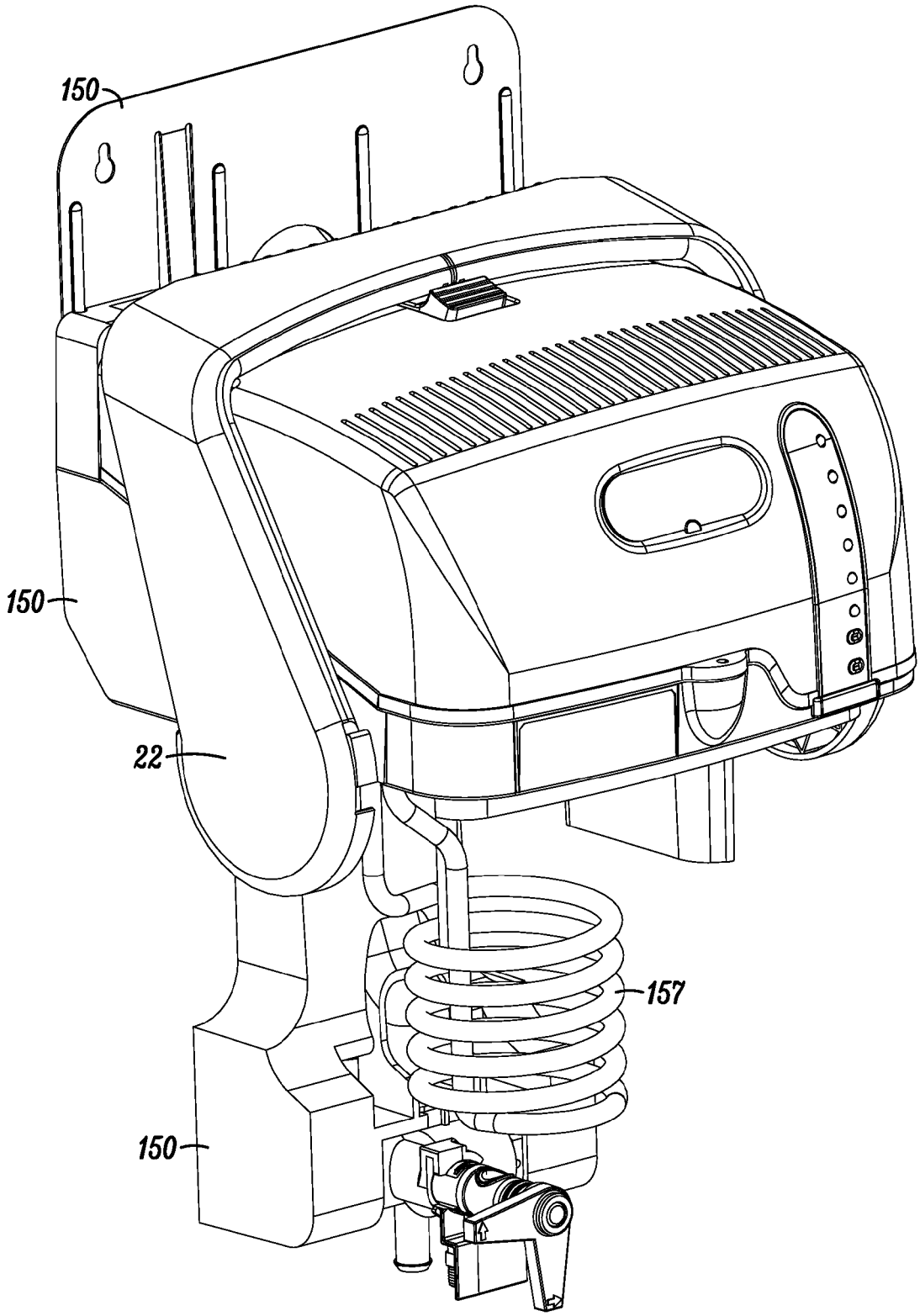
FIG. 19 is a front perspective view of the main structure of the humidifier, with an open top container part of the tank removed to show details.

The steam humidifier depicted in the figures includes a tank for containing water to be heated to generate steam. In some embodiments, an electrical resistance heater element is positioned in the tank for heating the water to generate steam, such as element 24 depicted in FIG. 1. In the embodiment of FIGS. 4-19, an electrical resistance heater is integral with the main structure 150. The main structure 150 is shown in FIG. 19 without the open top container 156. The main structure 150 includes heating element 157. As mentioned, in some embodiments, at least a portion of the tank is formed from a main structure 150 of the humidifier. The main structure 150 is also configured to support the weight of the steam humidifier and is generally not removed once it is installed. The weight of the tank 22, including the weight of the water contained within the tank 22, is generally transferred to the main structure 150. However, as discussed above, it is normally required that the interior of the tank 22 be cleaned at regular intervals to remove deposits that tend to form in the tank 22 when the water is boiled off as steam. To assist with accomplishing this, the open top container 156 is configured to be removed from the main structure 150. One example of a tank latching configuration that allows removal from the rest of the humidifier structure for easy cleaning of the tank is described in co-pending U.S. patent application Ser. No. 11/873,783, titled "Humidifier with Water Tank Quick Assembly Feature," filed on the even date herewith, which is hereby incorporated herein by reference.

Figure 10:
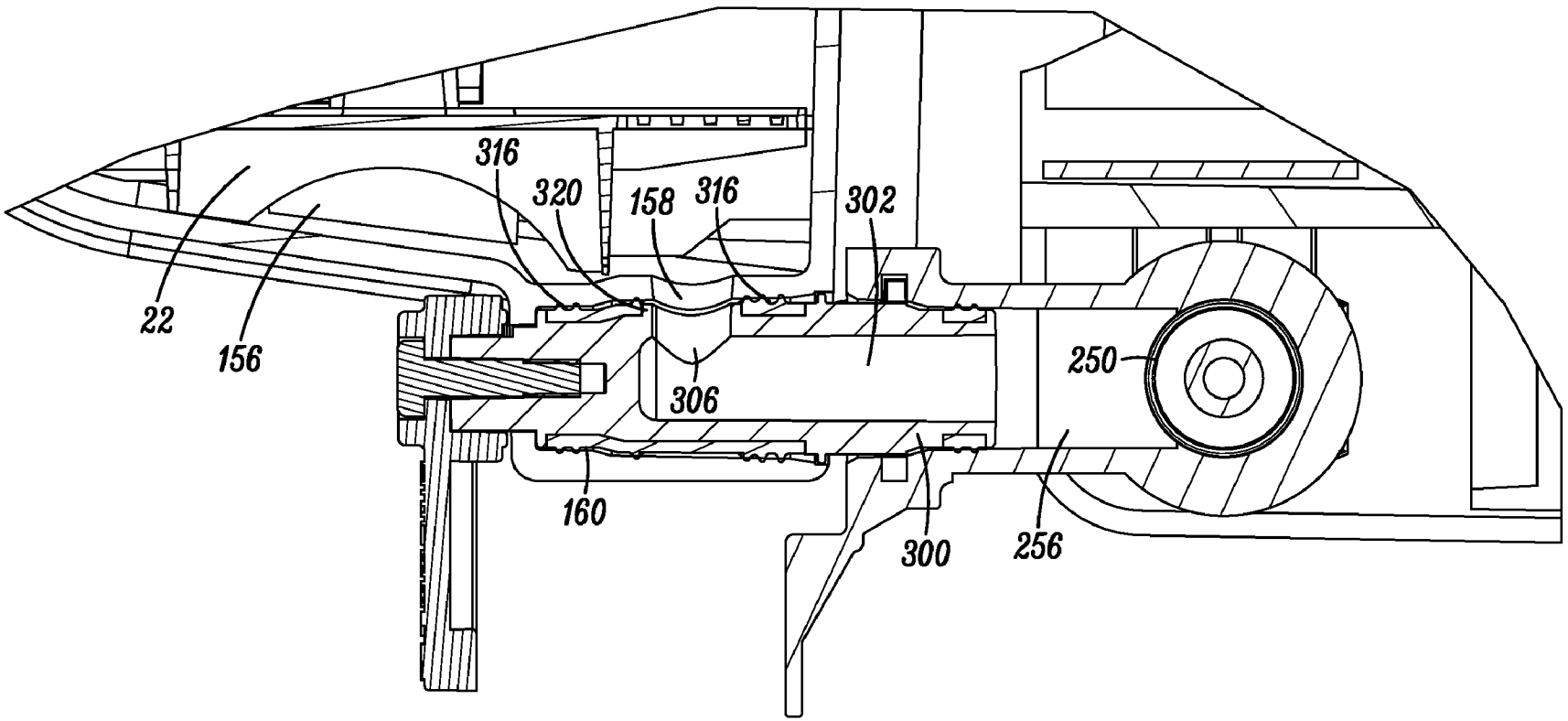
FIG. 10 is a cross-sectional view of a humidifier tank having a rotary spool valve within a cylindrical cavity of a valve manifold.
Figure 11:
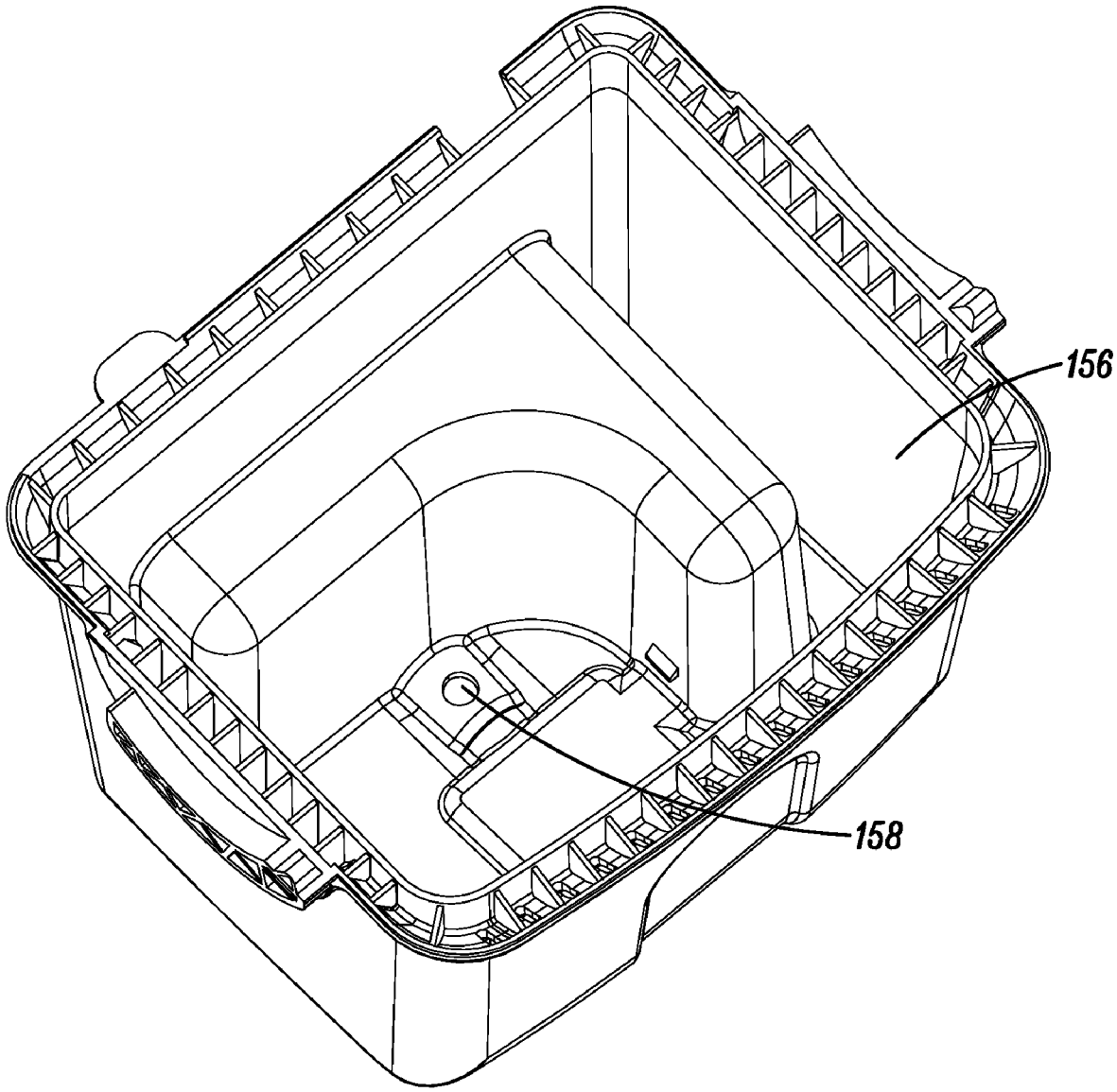
FIG. 11 is a top perspective view of an open top container of a humidifier configured for use with the quick liquid connection feature of FIGS. 4 to 10.
Figure 17:
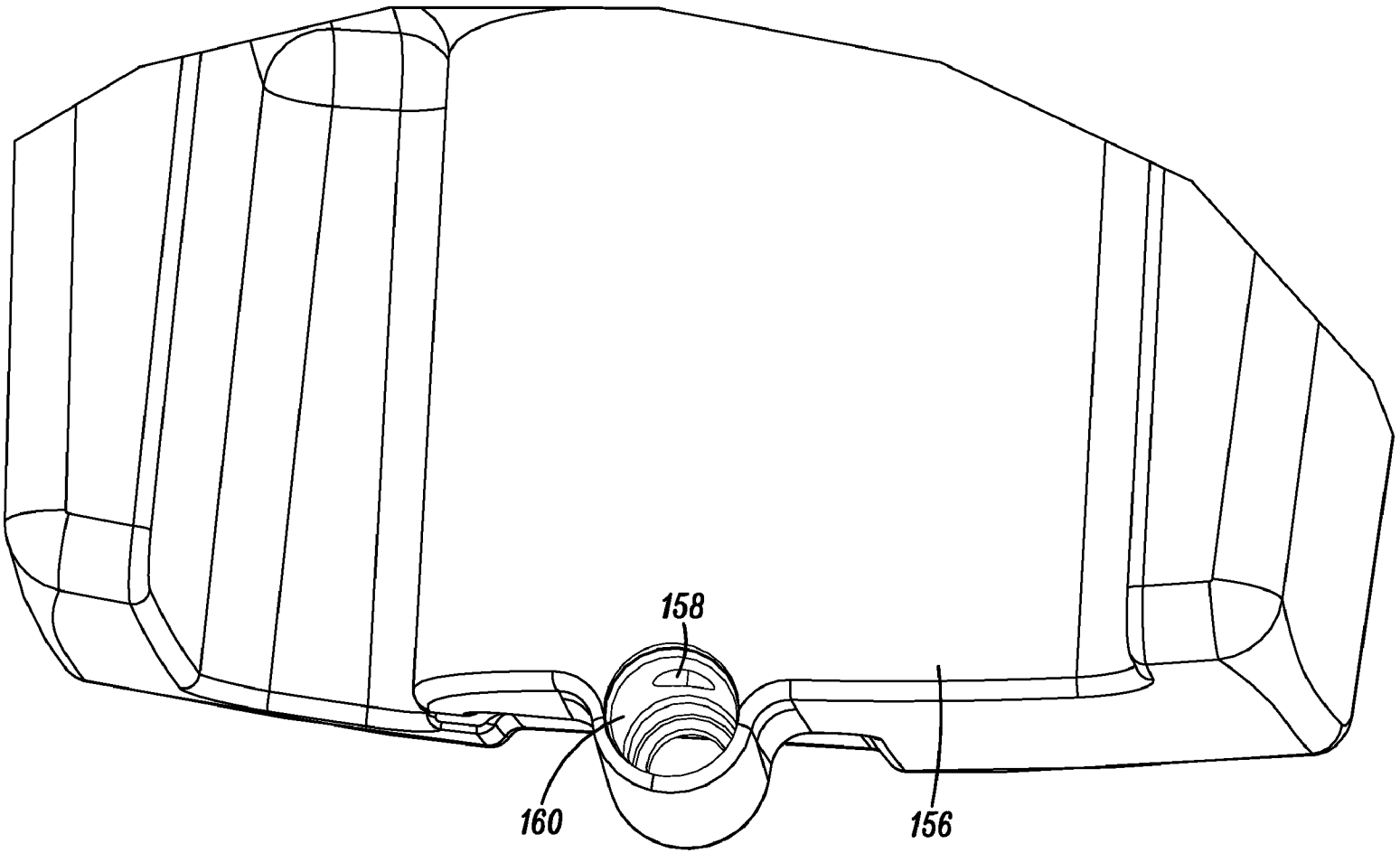
FIG. 17 is a view of a cylindrical cavity in a tank configured to receive a rotary spool valve.

An embodiment of an open top container 156 is shown in FIG. 11. Open top container 156 has a water passage 158 at the bottom of the container 156. As shown in FIG. 17, this water passage 158 is in fluid communication with a cylindrical cavity 160 that is integral with the open top container 156. The cylindrical cavity 160 is configured to receive at least a portion of a rotary spool valve, and as such is open at both ends. A cross section of the rotary spool valve 300 within the cylindrical cavity 160 in the open top container 156 is shown in FIG. 10.

Figure 15:
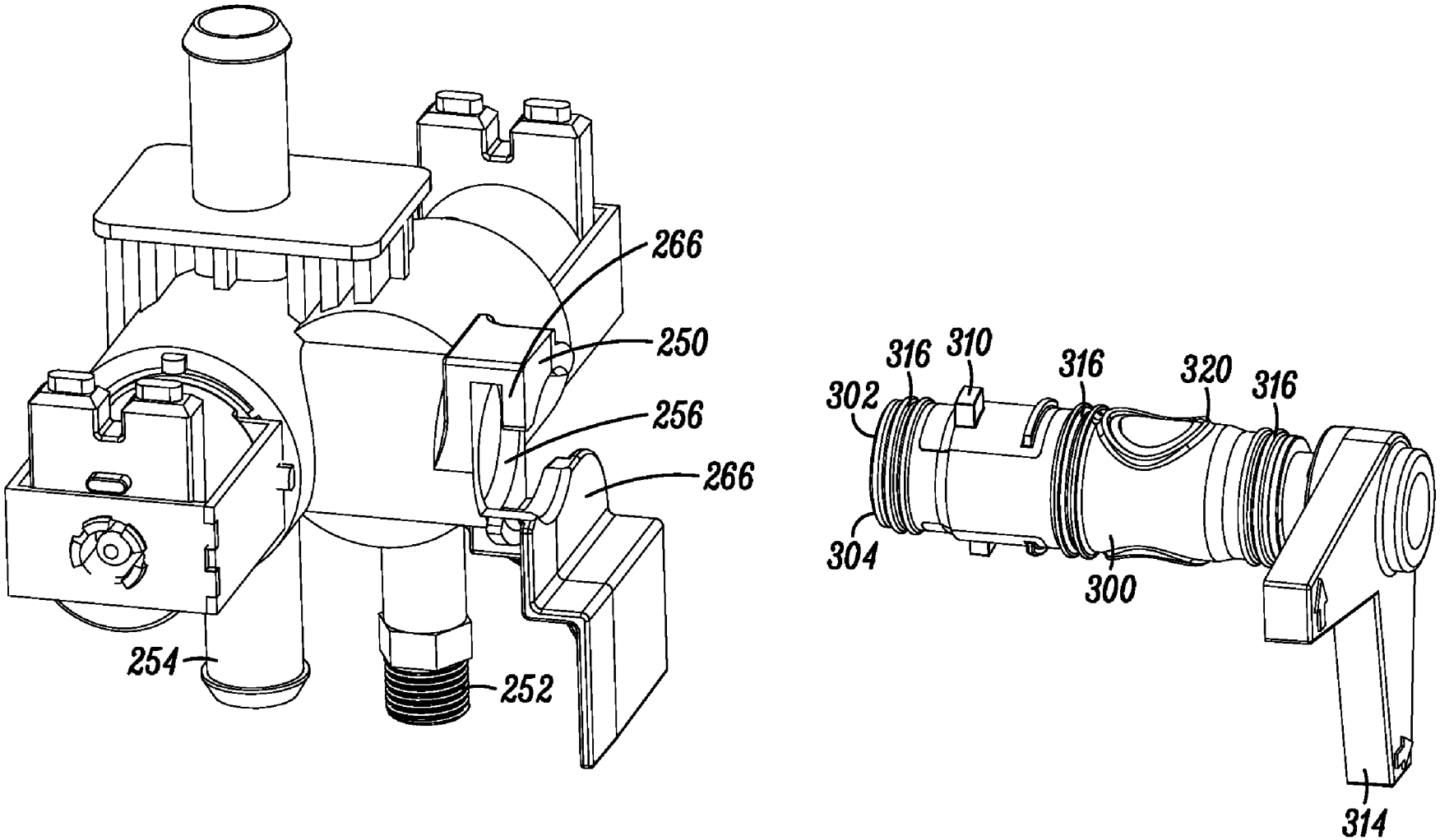
FIG. 15 is a perspective exploded view of the multi function valve tank interlock assembly of FIG. 6, including the valve manifold body and rotary spool valve.
Figure 16:
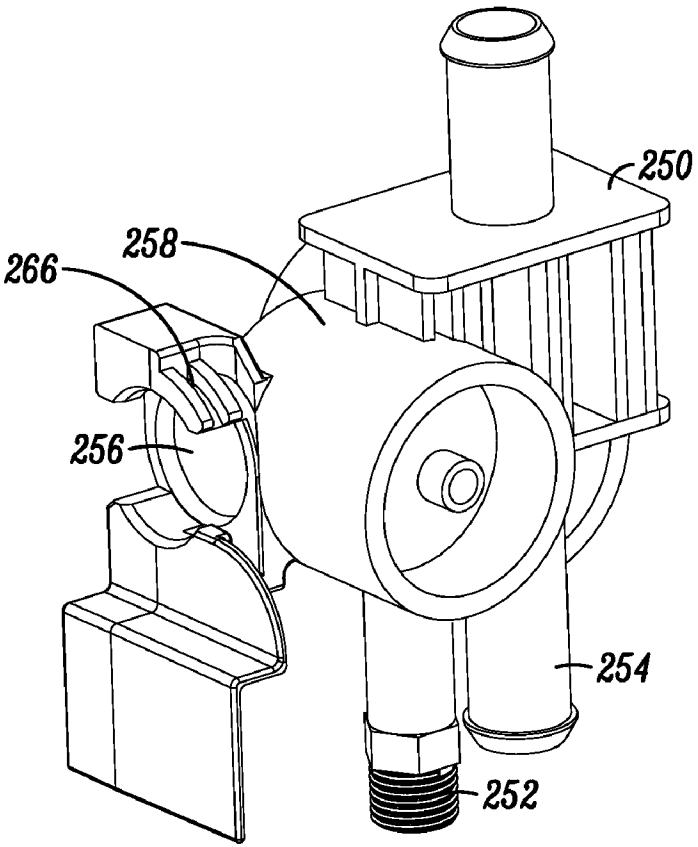
FIG. 16 is another perspective exploded view of the multi function valve tank interlock assembly of FIG. 6.
Figure 16:
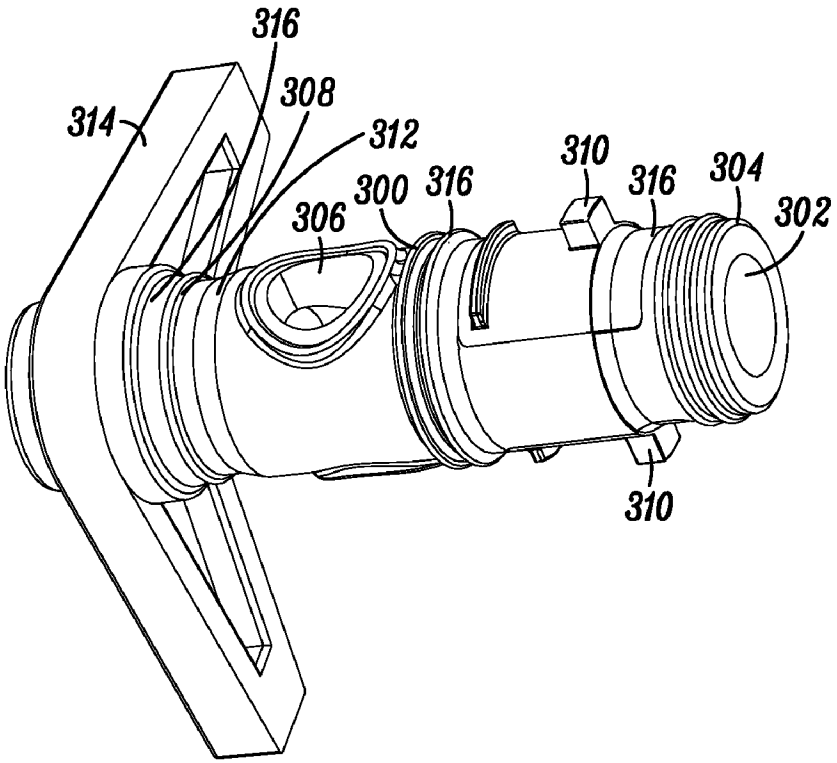

A valve manifold body 250 is supported by, or attached to, the main structure 150. An embodiment of the valve manifold body 250 is shown in FIGS. 15 and 16. The valve manifold body 250 is shown assembled to the humidifier in FIGS. 5, 13, and 14. Specifically, the valve manifold body 250 is secured or attached to the main structure 150. A cross section of the valve manifold body 250 and the tank 22 is shown in FIG. 10 (along with other components to be discussed below). As seen in FIGS. 15 and 16, the valve manifold body 250 defines a water supply connection 252. The water supply connection 252 is generally connected to a supply of water, such as a municipal water supply system or a well system. The valve manifold body 250 also has a water drain connection 254, where the water drain connection 254 is generally connected to a water receiving system, such as a municipal waste water system or a septic or drain field system.

The valve manifold body 250 includes a manifold chamber 256 that generally constitutes a cylindrical cavity. There is a first water supply passage 258 (FIG. 16) that fluidly connects the water supply connection 252 to the manifold chamber 256. As shown in FIG. 16, the first water supply passage 258 is configured to receive a water supply control valve (not shown) that controls the flow of water within the first water supply passage 258. For example, the water supply control valve may be a solenoid valve that receives an electrical signal from a controller to cause a valve seat to move towards and away from the supply passage 258. Other types of valves are usable. For example, pneumatic valves or manual valves may be used. There is also a second water supply passage 260 (FIG. 15) that fluidly connects the water drain connection 254 to the manifold chamber 256. In the depicted embodiments, the second water supply passage 260 is on an opposite side of the valve manifold body 250 from the first water supply passage 258. However, the second water supply passage 260 can be positioned in other locations. This second water supply passage 260 is also configured to receive a water drain control valve that controls the flow of water within the second water supply passage 260.

The valve manifold body 250 also includes one or more grooves 266 or similar features that are configured to receive one or more corresponding latching elements of the rotary spool valve, which will be further described herein. These one or more grooves 266 generally exist only around a part of the manifold chamber 256 so that the latching elements can be inserted into and removed from the grooves 266.

Figure 6:
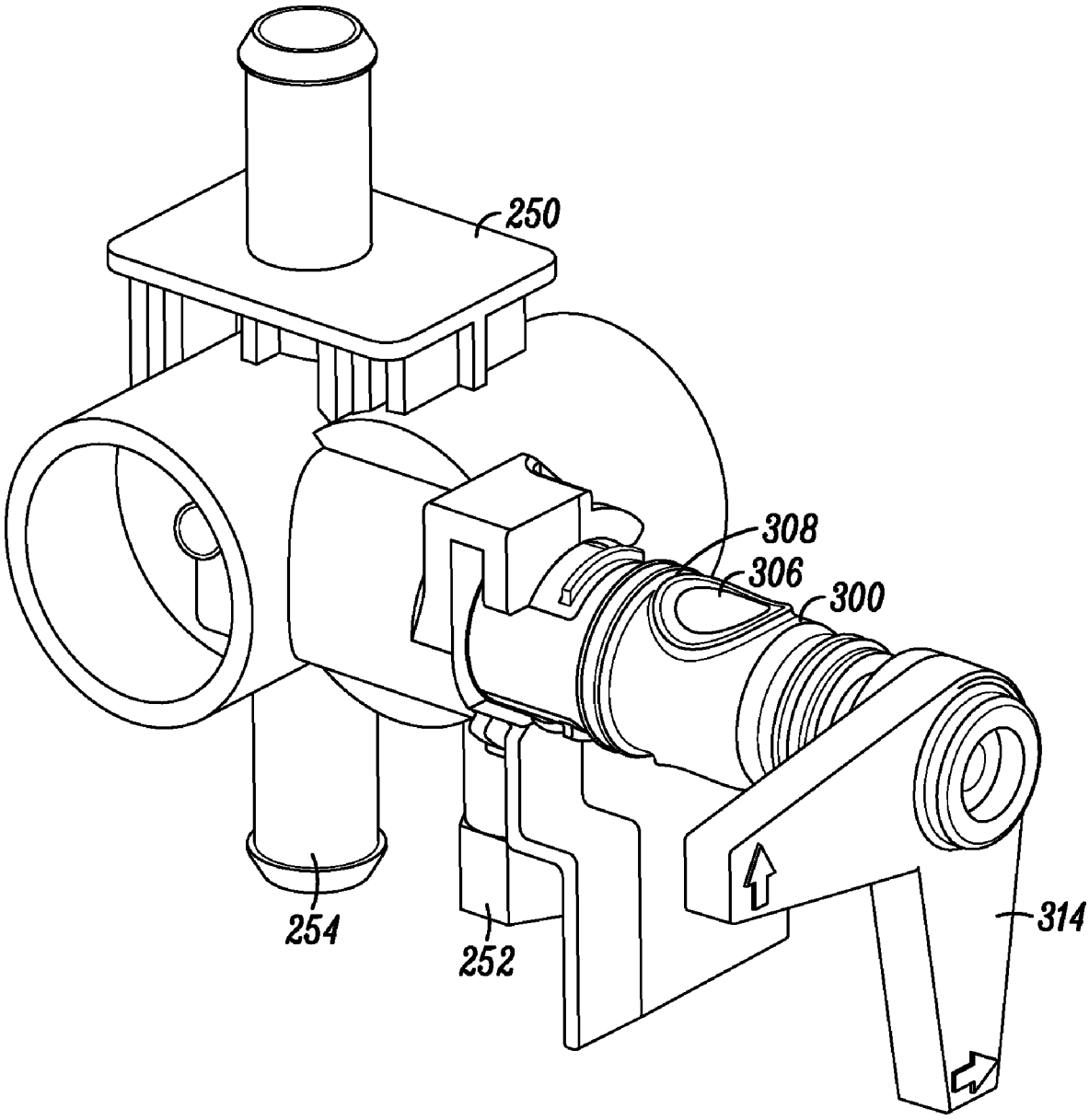
FIG. 6 is a perspective view of a multi function valve tank interlock assembly, including a rotary spool valve and a valve manifold body, configured to provide for readily disassembleable liquid connections to a tank of a humidifier.
Figure 7:
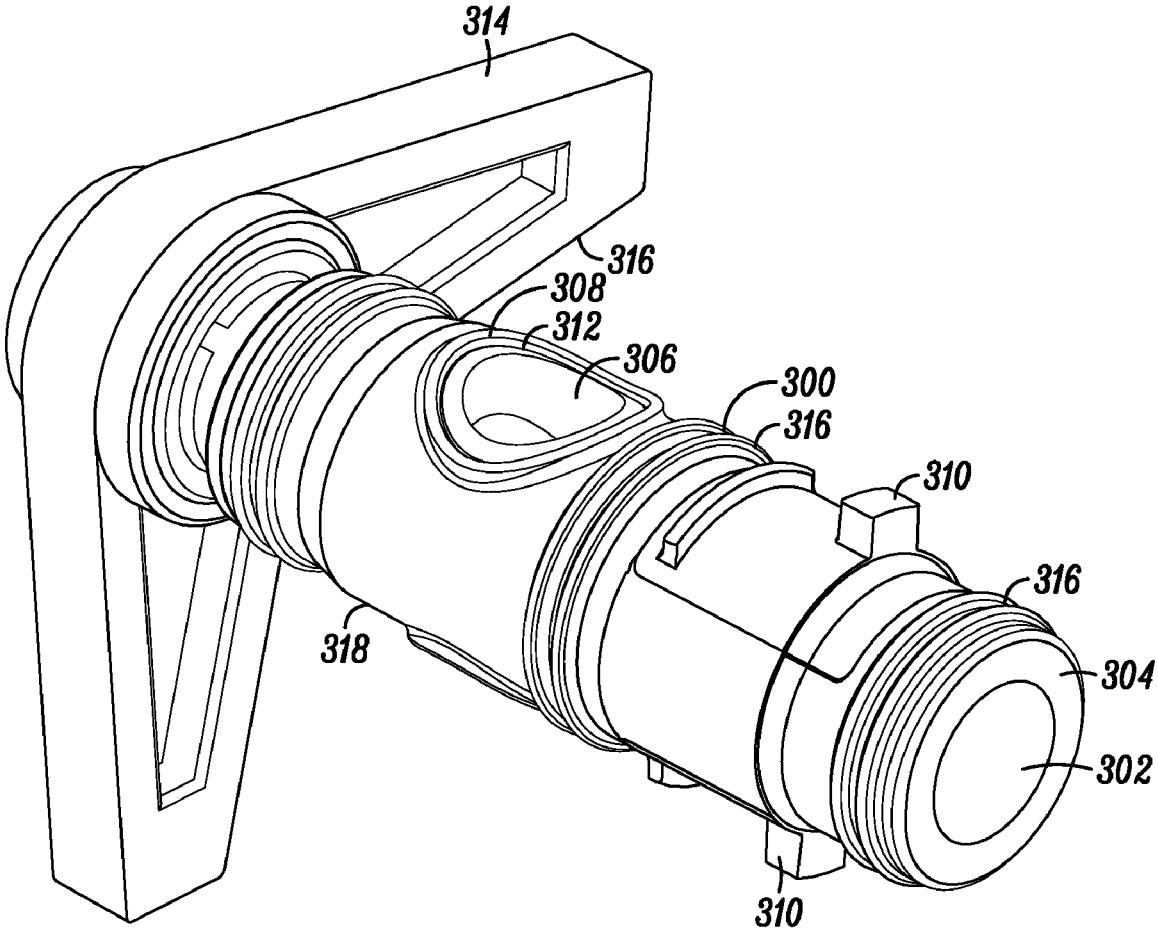
FIG. 7 is a perspective view of a rotary spool valve of the multi function valve tank interlock assembly of FIG. 6.
Figure 8:
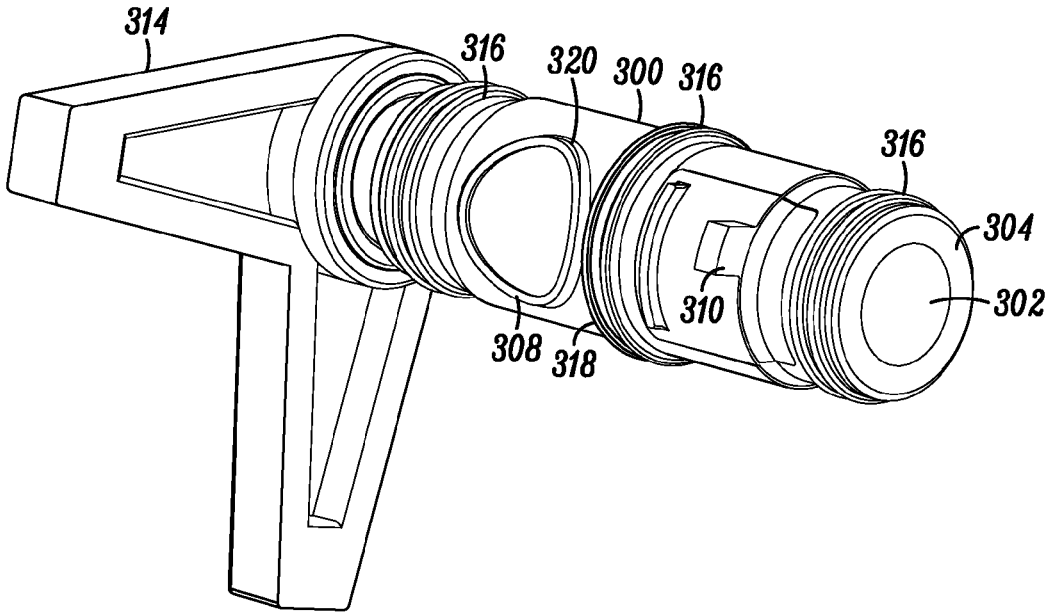
FIG. 8 is an alternate perspective view of the rotary spool valve of FIG. 7.

A valve is provided to control the fluid passageway between the tank 22 and the manifold chamber 256 in the valve manifold body 256. In the embodiment depicted in the figures, the valve is a rotary spool valve 300, as shown in FIGS. 6-8, for example. FIGS. 15 and 16 show the rotary spool valve 300 positioned next to the manifold body 250, ready to be inserted into the manifold chamber 256. The rotary spool valve 300 is generally cylindrical and positioned at least partially within the generally cylindrical cavity that constitutes the manifold chamber 256 (FIG. 15) and at least partially within the generally cylindrical cavity 160 (FIG. 10) of the open top container 156.

Other types and configurations of rotary valves are usable. For example, certain elements could be switched in their orientation. In one embodiment, grooves 266 could be swapped from valve manifold body 256 to open top container 156, in which case rotary spool valve 300 would have latching elements at an opposite end to engage with grooves 266 and would further have a handle at an opposite end to control the engagement of the latching elements.

Now referring to FIGS. 6-8, the rotary spool valve 300 has an axial fluid passage 302 that intersects with an end surface 304 of the rotary spool valve 300. The rotary spool valve 300 also has a radial fluid passage 306 that intersects with a radial surface 308 of the rotary spool valve 300. Now referring to FIGS. 15 and 16, the radial fluid passage 306 is configured to be in fluid communication with the manifold chamber 256 through the axial fluid passage 302. In addition, the rotary spool valve 300 has one or more latching elements such as latching tabs 310 that are configured to engage the one or more latching grooves 266 of the valve manifold body 250. The rotary spool valve 300 further includes one or more seals 312 about the intersection of the radial fluid passage 306 with the radial surface 308 of the rotary spool valve 300, as well as one or more outer seals 316 along radial surface 308. In some embodiments, there is also a handle 314 secured to an end of the rotary spool valve 300, as shown in FIGS. 7 and 8.

Various embodiments of seals 312, 316 are usable. In the embodiment depicted in FIGS. 7 and 8, seals 312, 316 are formed by a sealing sleeve 318 that is configured to be installed onto or over a valve body. For example, sleeve 318 may be a generally tubular part that has various openings for providing clearance with features of the rotary spool valve 300, such as radial passage 306 and latching tabs 310. In some embodiments, sleeve 318 is not separately installed onto spool valve 300, but rather is overmolded onto spool valve 300. Sleeve 318 further includes raised features as necessary to constitute seals 312, 316. These features that form seals 312, 316 are generally configured to provide a fluid-tight seal against cylindrical cavity 160 when rotary spool valve 300 is assembled to cylindrical cavity 160 of open top container 156. The valve body 317 is illustrated without the sealing sleeve 318 in FIG. 9. Radial fluid passage 306 is defined in the radial surface 309 of the valve body 317.

Figure 9:
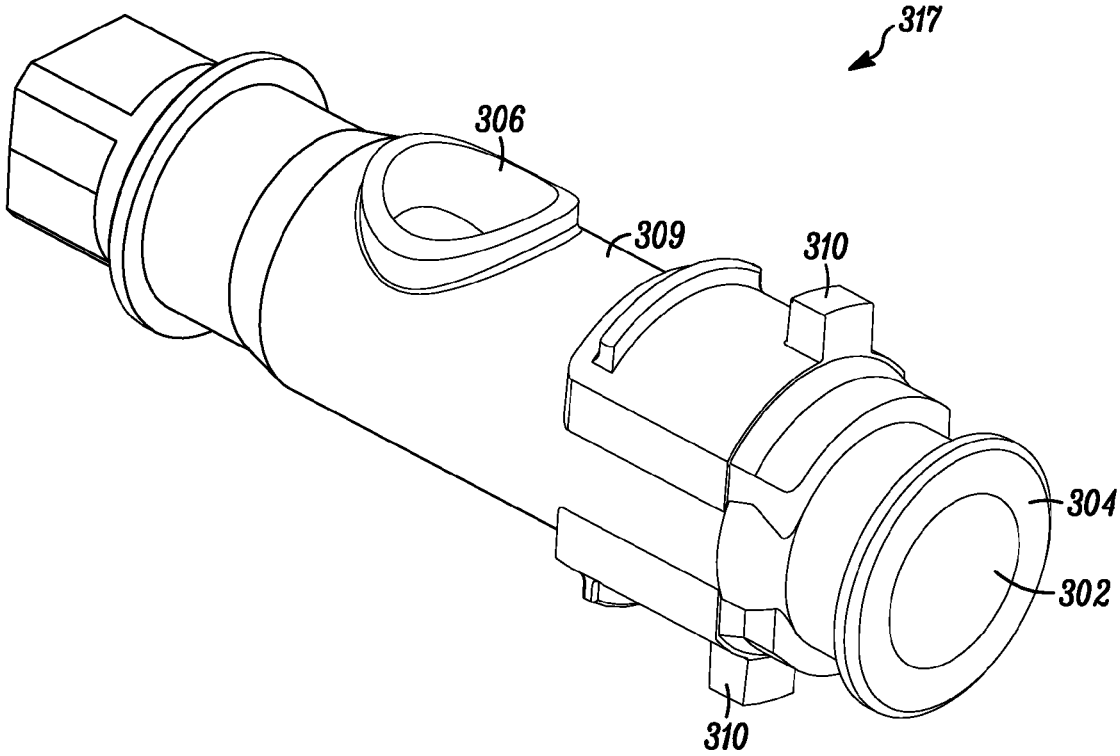
FIG. 9 is a perspective view of a rotary spool valve body of FIG. 7 without a sleeve.

In an alternative embodiment, the valve body 317 of FIG. 9 does not have a sealing sleeve fitted over it. Instead, grooves may be provided on the valve body 317 for receiving o-ring or other seals that constitute seals 312, 316.

When the rotary spool valve 300 is assembled into cylindrical cavity 160 of open top container 156 and manifold chamber 256 of manifold body 250 it is rotatable between at least two rotational positions. FIGS. 15 and 16 are exploded views of the valve tank interlock assembly, including the manifold body 250 and the rotary spool valve 300. In a first rotational position, latching tabs 310 are free of latching grooves 266, such that rotary spool valve 300 is free to be moved axially into and out of the bore of manifold chamber 256. FIG. 18 is a cross-sectional view of the rotary spool valve 300 within the manifold chamber 256 where the rotary spool valve 300 is in the first rotational position. Furthermore, in the first rotational position, radial fluid passage 306 does not register or align with water passage 158 within cylindrical cavity 160. In the first rotational position, seals 316 prevent water in tank 22 from leaking out of cylindrical cavity 160. In some embodiments such as seen in FIG. 8, a seal 320 is provided on radial surface 308 of rotary spool valve 300 that aligns with water passage 158 when rotary spool valve 300 is in the first rotational position and that directly seals water passage 158 from manifold chamber 256. However, in some other embodiments, seal 320 is not present. In this case, water may be able to travel from tank 22 to water passage 158 and then to the gap between radial surface 308 of rotary spool valve 300 and cylindrical cavity 160. However, this water will not be able to travel to manifold chamber 256 or escape from cylindrical cavity 160 because of seals 316 that form a seal of radial surface 308 against cylindrical cavity 160.

In the second rotational position of rotary spool valve 300, as shown in the cross-sectional view of FIG. 10, the radial fluid passage 306 in rotary spool valve 300 is aligned with water passage 158 in open top container 156. The alignment of these passages establishes a water communication pathway from tank 22 through radial fluid passage 306, to axial fluid passage 302 and into manifold chamber 256, where passages to water supply connection 252 and water drain connection 254 are defined, as described above. When rotary spool valve 300 is in the second rotational position, seal 312 is positioned about the opening for water passage 158, such that water is generally sealed from the radial surface 308 of rotary spool valve 300. However, any water that does pass by seal 312 is prevented from entering manifold chamber 256 or from flowing out of cylindrical cavity 160 by virtue of seals 316. The second rotational position of rotary spool valve 300 therefore allows the flow of water into and out of tank 22 to be controlled by the water control valves in the first and second water supply passages 258, 260. The second rotational position of rotary spool valve 300 also includes the one or more latching tabs 310 being engaged with the grooves 266 of the valve manifold body 250. The engagement of latching tabs 310 to grooves 266 causes rotary spool 300 to be locked in place such that axial movement of the rotary spool valve 300 is prevented. Because rotary spool valve 300 is also engaged with cylindrical cavity 160 of open top container 156, the prevention of axial movement of rotary spool valve 300 also prevents movement of open top container 156, effectively locking open top container 156 in its operational position.

When a humidifier constructed according to the principles of the present invention is in operation, the rotary spool valve 300 is in the second, locked, rotational position. As described above, this position allows the humidifier to function by allowing supply water to flow into tank 22 through rotary spool valve and allowing drain water to flow out of tank 22 through rotary spool valve 300. When the user intends to clean the tank, it may be necessary for the user to provide some input to the controls of the humidifier so that both water control valves in the first and second water supply passages 258, 260 will be kept closed during the cleaning process. Furthermore, normally the humidifier will be configured as part of the tank cleaning process to open the valve in the drain passage 254 to allow substantially all of the water in tank 22 to be removed through the drain. The user then uses handle 314 to rotate rotary spool valve to the first, unlocked, position. In this position, the water passage 158 is sealed and the latching tabs 310 are disengaged from corresponding grooves 266. The open top container 156 can then be removed from main structure 150. It is possible if the drain passages are obstructed or not functioning properly that there may still be water in the open top container 156 when the user attempts to remove it. Moreover, because the humidifier operates by heating water in the tank to convert it to steam, the remaining water may be very hot. The rotary spool valve 300 advantageously seals the water passage 158 in open top container 156 so that this water does not empty out when the open top container 156 is removed from main structure 150. If there is water in open top container 156 when the user removes it from main structure 150, the user can carry the open top container 156 to a sink or drain and then pour it out. The user can then manually clean the open top container 156.

To reassemble open top container 156 to main structure 150, the user brings open top container 156 into alignment with main structure 150 and manifold body 250 and inserts the portion of rotary spool valve 300 that extends outwards from cylindrical cavity 160 into manifold chamber 256 of valve manifold body 250. The rotary spool valve 300 is positioned so that the one or more locking tabs 310 are turned to be brought into alignment with grooves 266 of the valve manifold body 250, and then rotary spool valve 300 is rotated so that locking tabs 310 enter and engage with grooves 266. In this way, rotary spool valve 300 is locked to valve manifold body 250 which in turn causes open top container 156 to be secured to main structure 150. The humidifier can then resume normal operation. In some embodiments, the user can provide an indication, such as pressing a button or switch, to indicate that the humidifier has been reassembled after cleaning and can resume operation.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A steam humidifier comprising:

(i) a tank for containing water to be heated to generate steam;

(ii) a water connection manifold having a manifold chamber in fluid communication with a water supply passage and a water drain passage; and (iii) a rotary valve configured to control a fluid passage between the tank and the manifold chamber and further configured to control the position of one or more locking features, the rotary valve being rotatable between:

(a) a first locked position in which the fluid passage between the tank and the manifold chamber is open and the one or more locking features are engaged to lock the tank to a structure of the steam humidifier; and (b) a second unlocked position in which the fluid passage between the tank and the manifold chamber is closed and the one or more locking features are disengaged to unlock the tank from the structure of the steam humidifier.

2. The steam humidifier of claim 1, where a handle is attached to the rotary valve.

3. The steam humidifier of claim 1, where the rotary valve is a rotary spool valve.

4. The steam humidifier of claim 3, where the tank further comprises a heater element for heating water to generate steam.

5. The steam humidifier of claim 3, where the water supply passage and the water drain passage are each configured to receive water control valves.

6. The steam humidifier of claim 3, where the rotary spool valve further comprises one or more seals configured to seal the tank from the manifold chamber when the rotary spool is in the second unlocked position.

7. The steam humidifier of claim 5, where the tank is removable from the steam humidifier when the rotary spool valve is in the second unlocked position and the water control valves in the water supply passage and the water drain passage are each in a closed position, and where the rotary spool valve remains with the tank when removed.

8. A steam humidifier comprising:

(i) a tank for containing water to be heated to generate steam, the tank having:

(a) a generally cylindrical cavity; and (b) a water passage fluidly connecting a bottom portion of the tank to the generally cylindrical cavity;

(ii) a main structure configured to support the tank;

(iii) a valve manifold body configured to be supported by the main structure, the valve manifold body defining:

(a) a water supply connection;

(b) a water drain connection;

(c) a manifold chamber including a second generally cylindrical cavity;

(d) a first water supply passage fluidly connecting the water supply connection to the manifold chamber, the first water supply passage further configured to receive a water supply control valve;

(e) a second water supply passage fluidly connecting the water drain connection to the manifold chamber, the second water supply passage further configured to receive a water drain control valve; and (f) one or more latching features;

(iv) a rotary spool valve, the rotary spool valve being generally cylindrical and positioned at least partially within the generally cylindrical cavity of the manifold chamber and at least partially within the generally cylindrical cavity of the tank, the rotary spool valve defining:

(a) an axial fluid passage that intersects with an end surface of the rotary spool valve;

(b) a radial fluid passage that intersects with a radial surface of the rotary spool valve and is configured to be in fluid communication with the manifold chamber through the axial fluid passage;

(c) one or more latching tabs configured to engage the one or more latching features of the valve manifold body; and (d) one or more seals about the intersection of the radial fluid passage with the radial surface of the rotary spool valve;

(v) a handle secured to an end of the rotary spool valve.

9. The steam humidifier of claim 8, where the handle is configured to rotate between at least two positions.

10. The steam humidifier of claim 9, where in a first position of the handle, the radial fluid passage of the rotary spool valve registers with the water passage of the tank.

11. The steam humidifier of claim 10, where in a first position of the handle, the one or more latching tabs of the rotary spool valve are engaged with the one or more latching features of the valve manifold body.

12. The steam humidifier of claim 9, where in a second position of the handle, the radial spool valve blocks the water passage of the tank.

13. The steam humidifier of claim 12, where in a second position of the handle, the one or more latching tabs of the rotary spool valve are disengaged from the one or more latching features of the valve manifold body.

14. The steam humidifier of claim 8, where the one or more latching tabs project from the radial surface of the rotary spool valve.

15. The steam humidifier of claim 8, where the seal structures comprise a sleeve fitted over the rotary spool valve.

16. The steam humidifier of claim 10, where the generally cylindrical cavity of the tank is coaxial with the generally cylindrical cavity of the manifold chamber.

17. A method of removing a tank of a steam humidifier, the method comprising:

(i) closing one or more valves in a valve manifold body to isolate a water supply and a water drain from a manifold chamber of the valve manifold body;

(ii) rotating a handle attached to a rotary spool valve to cause a fluid passage leading from the tank to the manifold chamber of the valve manifold body to be blocked and causing locking features of the rotary spool to disengage from a supporting structure of the steam humidifier;

(iii) removing the tank and the rotary spool valve from the supporting structure.

18. The method of claim 17, where the rotary spool valve includes a radial fluid passage that intersects with a radial surface of the rotary spool valve and an axial fluid passage that intersects with an end of the rotary spool valve, where the radial fluid passage and the axial fluid passage intersect with each other, such that prior to rotating the handle, the axial and radial fluid passages form a fluid passage from the tank to the manifold chamber.

19. The method of claim 18, where the rotary spool valve further comprises one or more seals about the radial fluid passage that effect a seal of the fluid passage of the tank after the handle has been rotated.

* * * * *